US012577794B2

(12) United States Patent
Jablonsky

(10) Patent No.: US 12,577,794 B2
(45) Date of Patent: Mar. 17, 2026

(54) FIRE-RESISTANT COVER FOR CORBEL SYSTEM

(71) Applicant: ALP Supply, Inc., Fairless Hills, PA (US)

(72) Inventor: David S. Jablonsky, Washington Crossing, PA (US)

(73) Assignee: ALP Supply, Inc., Fairless Hills, PA (US)

( * ) Notice: Subject to any disclaimer, the term of this patent is extended or adjusted under 35 U.S.C. 154(b) by 325 days.

(21) Appl. No.: 18/329,788

(22) Filed: Jun. 6, 2023

(65) Prior Publication Data

US 2023/0392390 A1 Dec. 7, 2023

Related U.S. Application Data

(60) Provisional application No. 63/349,632, filed on Jun. 7, 2022.

(51) Int. Cl.
*E04F 19/02* (2006.01)
*E04B 1/94* (2006.01)

(52) U.S. Cl.
CPC ..... *E04F 19/022* (2013.01); *E04B 1/94* (2013.01)

(58) Field of Classification Search
CPC ..... E04B 1/94; E04F 19/022; E04F 19/028
See application file for complete search history.

(56) References Cited

U.S. PATENT DOCUMENTS 4,479,916 A * 10/1984 Blatchford ..... E04C 2/40 264/263
6,494,639 B1 * 12/2002 Friend ..... E04B 1/215 403/360
8,209,925 B2 * 7/2012 Foley ..... E04B 1/2403 403/403
8,365,484 B2 * 2/2013 Foley ..... E04B 1/4114 403/403
10,370,845 B2 * 8/2019 Francies, III ..... E04B 1/483
10,883,265 B2 * 1/2021 Kelly ..... E04B 1/4114
2011/0138735 A1 * 6/2011 Foley ..... E04B 1/4114 52/848

(Continued)

FOREIGN PATENT DOCUMENTS

EP 3650607 A1 5/2020

OTHER PUBLICATIONS

MeadowBurke System (Year: 2018).*

(Continued)

*Primary Examiner* — Paola Agudelo
(74) *Attorney, Agent, or Firm* — Dority & Manning, P.A.

(57) ABSTRACT

A cover for a corbel that may be incorporated into a precast concrete structure is provided having a shell with an interior and an exterior, triangular sides and a bottom extending between the two sides. The opening in the cover is defined by a perimeter, with a first section of the perimeter lying in a first plane and a second section of the perimeter lying in a second plane. The intersection of the first plane and the second plane forms a right angle. The first section of the perimeter may be attached to the base of the ledge component of the corbel, and the second section of the perimeter may be attached to the back plate of the ledge or the mount plate.

19 Claims, 4 Drawing Sheets

(56) References Cited

U.S. PATENT DOCUMENTS

| | | | | |
|---|---|---|---|---|
| 2016/0083203 | A1* | 3/2016 | Mueller | B65G 69/008 52/741.3 |
| 2018/0347179 | A1* | 12/2018 | Kelly | E04B 1/4114 |
| 2020/0318341 | A1* | 10/2020 | Jablonsky | E04B 1/215 |
| 2021/0277650 | A1* | 9/2021 | Recker | E04B 1/41 |
| 2021/0396006 | A1* | 12/2021 | Collins | E04B 1/625 |
| 2022/0356007 | A1* | 11/2022 | Mirzoyan | E04H 7/065 |

OTHER PUBLICATIONS

YouTube video https://www.youtube.com/watch?v=j3StuH3mw_s &t=3s Meadow Burke RapidLok 720p 2 (Year: 2016).*

PCT ISR PCT/US2023/024641 Sep. 28, 2023.

Meadow Burke, Lifting Precast Strong, XP054980323, 2016, 4 Pages. Retrieved from https:/www.youtube.com/watch?v=j3StuH3mw_s.

* cited by examiner

FIRE-RESISTANT COVER FOR CORBEL SYSTEM

CROSS-REFERENCE TO RELATED APPLICATIONS

The present application claims priority to U.S. Provisional Patent Application 63/349,632 filed on Jun. 7, 2022, the disclosure of which is incorporated by reference herein in its entirety.

FIELD

The present invention is directed to a fire-resistant cover for a corbel system used in precast concrete structures. In particular, the cover is designed to shield the exposed portions of a metal alloy corbel, when the corbel is subjected to intense heat, such as in a fire.

BACKGROUND OF THE INVENTION

Various prior art devices have been developed to connect one precast concrete component to another. For example, a corbel may be supported by a vertical precast concrete component, such as a wall, and the corbel may in turn support a horizontal, concrete beam.

Jablonsky—U.S. patent application Ser. No. 2020/0318341 A1 discloses a concrete embeddable corbel system. The corbel has a mount plate with keyhole slots. Anchors extending from the back of the mount plate are embedded in a precast concrete component, with the front of the mount plate flush with the surface of the concrete component. A ledge engages the mount plate and supports a concrete beam. The ledge has a back plate, with studs to engage the keyhole slots in the mount plate, and a base connected at a right angle to the back plate, upon which a beam may rest. A gusset is provided between the back plate and the base of the ledge, to provide reinforcement.

Kelly et al.—U.S. Pat. No. 10,883,265 B2 disclose a corbel for concrete structures. The corbel has a receiving member, with anchors extending from the back, which is embedded in a precast concrete component. An attachment member, with a horizontal base for supporting a concrete beam, engages slots in the receiving member. In particular, vertical members (26) of attachment member (14) engage the slots in receiving member (12). Additionally, the vertical members function as gussets, to provide reinforcement of the horizontal base.

The corbels used in conjunction with concrete structures are typically made of steel. In the event of a fire, the corbel may be exposed to intense heat sufficient to cause the steel to soften and fail. Corbels for use in structures incorporating precast concrete are typically designed to have a minimum 1-hour fire rating, according to ASTM-E119, which measures the duration for which a specific building assembly can withstand a fire. It is often desirable, however, to provide the corbel with a higher rating, such as a 2-hour, 3-hour or even longer fire rating.

One prior art method of increasing the fire rating of a steel corbel is to encase the ledge component of the corbel in concrete, allow the concrete to cure, and install the ledge, that is, mate the ledge and the mount plate, with the concrete in place. There are a number of shortcomings with the prior art method. The concrete greatly increases the weight of the ledge, which makes installation of the ledge more physically demanding. Encasing the ledge in concrete and allowing the concrete to cure prior to installation adds steps to the manufacturing process. After the ledge is encased in concrete and installed in a precast concrete structure, the ledge cannot be visually inspected, without breaking the concrete apart.

Prior art devices for insulating structural components from heat generated by a fire are typically designed to engage a specific structural shape. Golliek—U.S. Pat. No. 775,562 discloses a heat-protective covering for columns or pillars. Sei Nikai et al.—U.S. Pat. No. 3,570,208 and Quigg—U.S. Pat. No. 3,908,327 disclose a fireproof layer, which can be attached to steel I-beams. Rumsey—U.S. Pat. No. 4,706,426 discloses a fire-rated, flush-mounted guard for the corner of walls. Despite the proliferation of prior art systems developed to insulate structural components, such systems are not readily adaptable to corbels used to support precast concrete beams.

Accordingly, there remains a need in the construction industry for a corbel cover that is economical to manufacture, lightweight, easy to install, and effective in providing protection against the extreme heat generated by a fire.

SUMMARY OF THE INVENTION

The present invention includes a fire-resistant cover for a corbel used in precast concrete structures, and the combination of the cover and a corbel incorporated into a precast concrete structure, referred to as a corbel system.

The cover has a shell having an interior, an exterior, a first side, a second side opposite the first side, and a bottom extending from the first side to the second side. The cover has an opening defined by a perimeter. The perimeter has a first section lying in a first plane and a second section lying a second plane. The first plane and the second plane are aligned at an angle of approximately 90°, for example in the range of from 85° to 95°, depending upon the angle of the ledge of the corbel, relative to the mount plate or supporting precast concrete wall or beam. The first side and the second side of the shell may be parallel to each other.

The first side of the shell may be in the shape of a triangle having a first right angle positioned on the perimeter at an intersection of the first plane and the second plane. Correspondingly, the second side of the shell may also be in the shape of a triangle having a second right angle positioned on the perimeter at an intersection of the first plane and the second plane. Accordingly, the first side of the cover may be characterized as having a hypotenuse opposite the first right angle, and the second side may be characterized as having a hypotenuse opposite the second right angle. The bottom of the shell may extend from the hypotenuse of the first side to the hypotenuse of the second side, to create an enclosure for the corbel.

The shell component of the cover may be metallic, that is, comprising a metal or metal alloy, for example, stainless steel or carbon steel. The cover may be provided with a fire-resistant coating, in order to increase the duration of the fire rating. The coating may be selected from intumescent, sprayed fiber and cementitious coatings.

The cover is employed as part of a corbel system used in combination with a precast concrete structure, such as a wall or post, to support a precast beam, joist, girder, double tee or the like, aligned substantially perpendicular to the precast concrete structure. Examples of corbel systems used with precast concrete structures may be found in Jablonsky—U.S. patent application Ser. No. 2020/0318341 A1 and Kelly et al.—U.S. Pat. No. 10,883,265 B2.

In one embodiment of the invention, the corbel component of the system includes a mount plate with a plurality of slots extending through the mount plate, from the face to the back. Anchors affixed to the back of the mount plate are embedded in the precast concrete structure, thereby aligning the face of the mount plate flush with the structure. A ledge is provided with projections corresponding to the slots in the mount plate. The ledge has a base for supporting a beam or similar structure on the corbel. When the corbel is assembled, the projections in the ledge engage the mount plate, and maintain the base in a substantially horizontal position, with the base aligned perpendicular to the mount plate. By way of example, the ledge may include a back plate, which is aligned perpendicular to the base. The back plate may have a plurality of headed studs, which engage keyhole slots in the mount plate, to secure the ledge. A gusset extending from the underside of the base to the front of the back plate provides reinforcement to the ledge.

A space is created between the base of the ledge, the face of the mount plate, and the shell. A solid insulating material may be provided in the space to further protect the corbel from high heat during a fire. In particular, it is believed to be critical to protect the gusset or other structural element supporting the base from collapsing toward to the mount plate. By way of example, the insulating material may have a thermal conductivity of 0.075 W/m·° K or less. It is believed that with the insulating material in the covered space defined by the shell of the cover, the corbel system can meet or exceed a 3-hour fire rating, according to ASTM-E119.

The cover may be attached to the corbel by one or more fasteners, extending through each of the first and second side of the shell and engaging the ledge component of the corbel. Accordingly, the cover may have a first hole extending through the first side of the shell adjacent the perimeter, and a second hole extending through the second side of the shell adjacent the perimeter.

The ledge is provided with receivers for engaging the fasteners. The receivers may be tabs extending from the periphery of the ledge, such as a sheet-like tabs welded to the ledge and aligned coplanar to the side of the adjacent cover. The tab may have a hole for receiving the threaded shaft of a fastener. In an alternative embodiment of the invention, the receivers may be drilled and tapped holes, in the sides of the ledge, such as in the sides of the base and/or the sides of the back plate.

In another embodiment of the invention, the second section of the perimeter of the shell abutting the mount plate may be provided with an outwardly extending flange, and the flange component may be attached to the mount plate of the corbel, in particular, adjacent the outer edge of the mount plate.

In yet another embodiment of the invention, the cover may be attached to the corbel by welding or use of a fire-resistant epoxy adhesive.

DETAILED DESCRIPTION OF THE INVENTION

Without intending to limit the scope of the invention, the preferred embodiments and features are hereinafter set forth. All of the United States patents and published patent applications cited in the specification are incorporated herein by reference.

Figure 1:
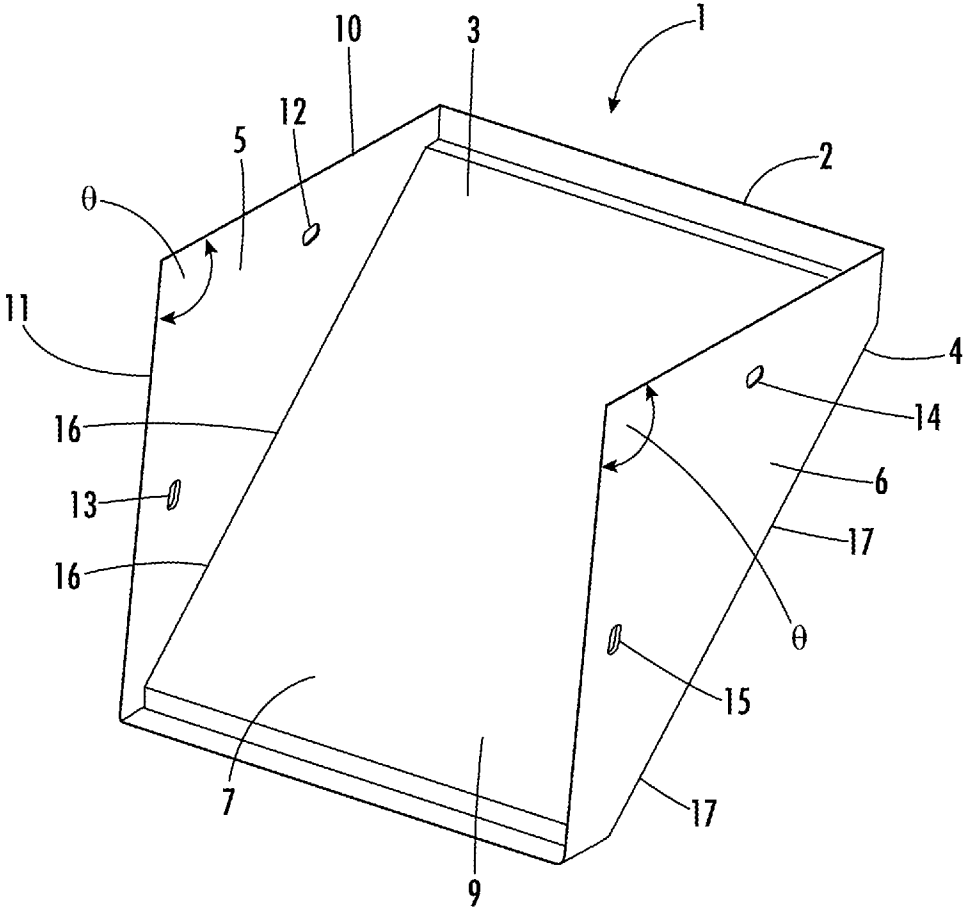
FIG. 1 is a top perspective view of the corbel cover of the present invention.

Referring to FIG. 1, cover 1 has shell 2, which defines interior 3 and exterior 4. Shell 2 has side 5 and side 6, opposite side 5, and bottom 7, extending from side 5 to side 6. Shell 2 is open to interior 3. Opening 8 is defined by a perimeter 9, which is characterized by a first section 10, lying in a first plane, and a second section 11, lying in a second plane.

Typically, the first plane and the second plane are aligned at an angle of approximately 90°, as shown as angles "θ" in FIG. 1, measured at the intersections of first section 10 and second section 11 of perimeter 9. The angle is selected to correspond to the angle of the ledge of the corbel, relative to the mount plate or supporting precast concrete structure. By way of example, the first plane and the second plane may be aligned at an angle of from 850 to 95°.

Shell 2 has holes 12 and 13 in side 5, adjacent perimeter 9, and holes 14 and 15 in side 6, adjacent perimeter 9. The holes 12-15 are designed to accept a fastener, which can engage the ledge of a corbel, and secure the cover in place.

In the embodiment illustrated in FIG. 1, sides 5 and 6 are triangular shaped, with edges 16 and 17, respectively, opposite angle θ. Accordingly, bottom 7 extends between the hypotenuses identified as edges 16 and 17.

Shell 2 of cover 1 may be made primarily of a metal or metal alloy, such as stainless steel or carbon steel provided with a fire-resistant coating. By way of example, the thickness of shell 2 may be 0.1 inches or less. Shell 2 may be made by welding the components together, folding a unitary piece of sheet metal, or a combination of welding and folding.

The exterior or interior or both the exterior and interior of shell 2 may be provided with a fire-resistant coating, in order to increase the duration of the fire rating. The coating may be applied to the exterior of the shell, the interior of the shell or both the exterior and the interior of the shell. The coating may be selected from intumescent, sprayed fiber and cementitious fire-resistant coatings. Intumescent coatings are made of a substance that swells up to 100 times its original thickness and chars when exposed to heat, thereby insulating the protected article. The use of fire-resistant coating to protect structural element, such as steel, by applying such coating to the structural element is known to those skilled in the art.

Figure 2:
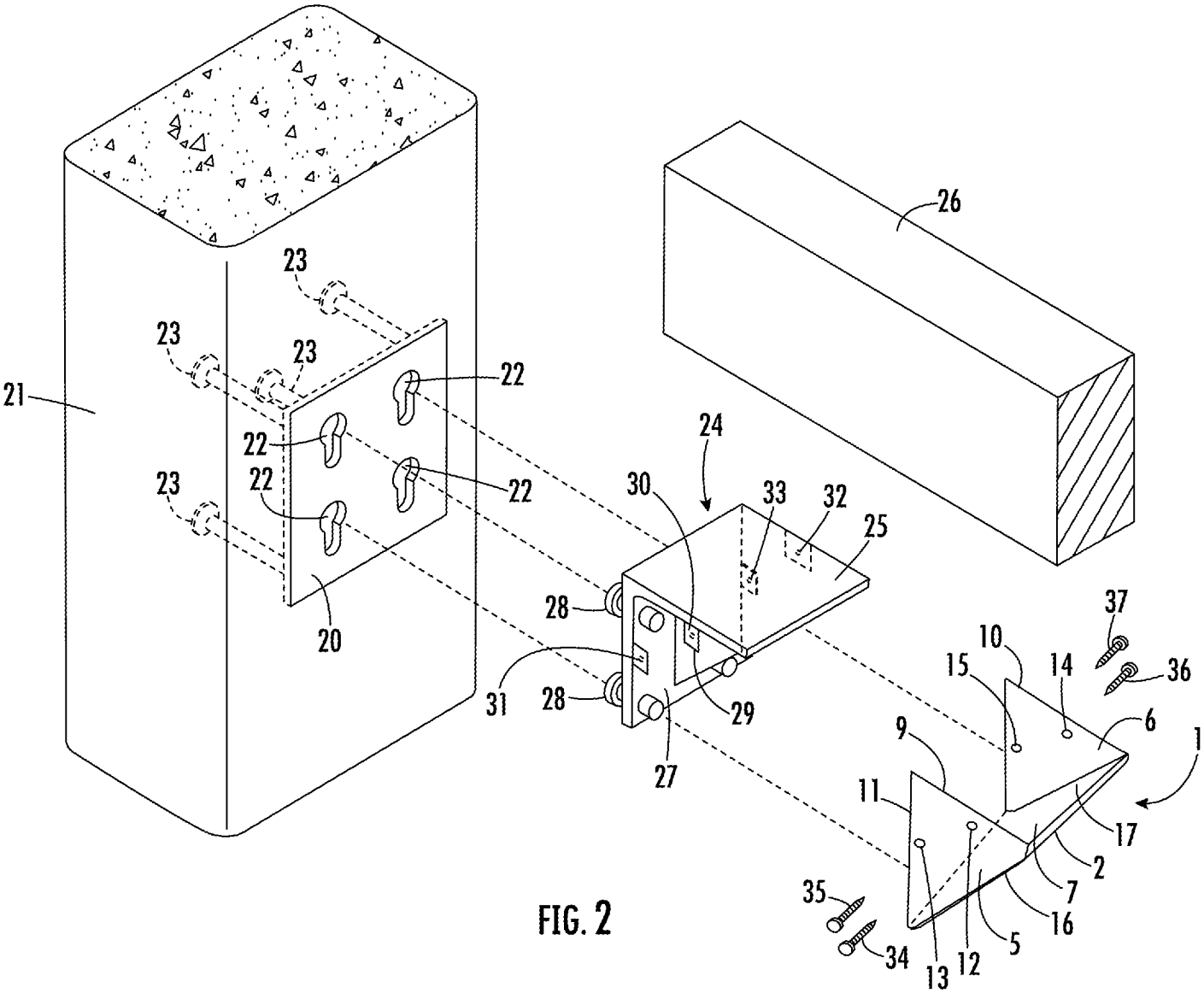
FIG. 2 is an exploded view of a precast concrete structure, a corbel, and the corbel cover of the present invention.
Figure 3:
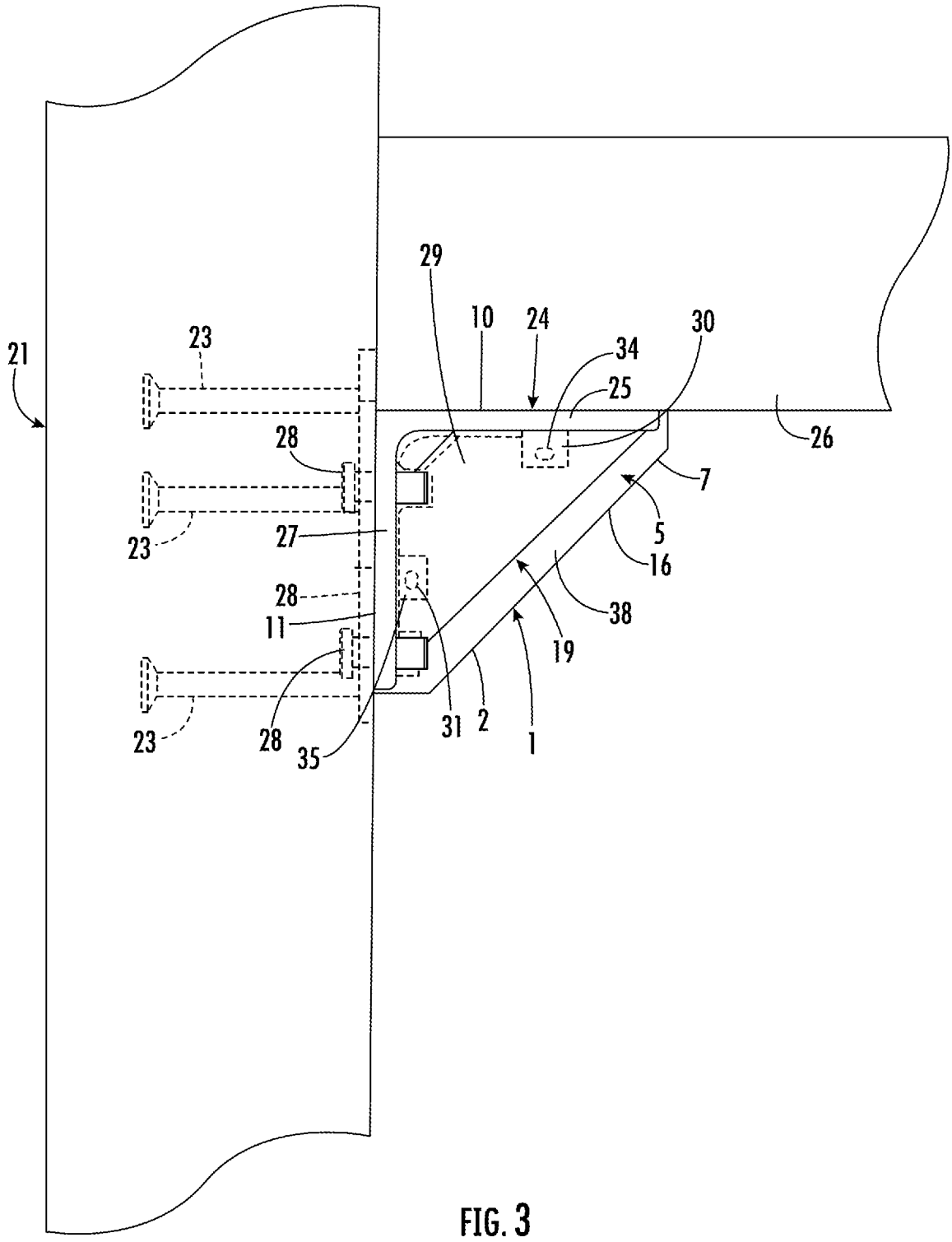
FIG. 3 is a side elevation view of the corbel cover installed over a corbel.

FIGS. 2 and 3 illustrate a precast concrete structure, a corbel, and the cover of the present invention. Corbel 19 has mount plate 20 embedded in precast concrete structure 21, which can be a wall, post, or other upright structure. Mount plate 20 has a plurality of keyhole slots 22 and a plurality of anchors 23 extending from its back side and embedded in concrete structure 21. Typically, mount plate 20 will be installed flush with the face of the precast concrete structure.

Ledge 24 has base 25, for supporting beam 26, and back plate 27, with a plurality of studs 28 extending rearward. Studs 28 are configured to engage keyhole slots 22 in mount plate 20. Gusset 29 extends between the lower side of base 25 and the face of back plate 27. Typically, base 25 and back plate 27 of ledge 24 are aligned at a 900 angle. Accordingly, when corbel 19 is assembled, with mount plate 20 aligned vertically in concrete structure 21, base 25 is aligned horizontally.

Ledge 24 is provided with receivers for attaching cover 1 over corbel 19. As shown in FIGS. 2 and 3, the receivers are tabs 30 and 31 extending from the lower side of base 24 and the front of back plate 27, respectively, on one side of ledge 24, and tabs 32 and 33 extending from the lower side of base 24 and front of back plate 27, respectively, on the opposite side of ledge 24. Tabs 30-33 may be welded to ledge 24, with the tabs aligned perpendicularly to ledge 24 and coplanar to sides 5 and 6 of cover 1. Tabs 30-33 may each be provided with a hole for receiving a fastener.

Figure 4:
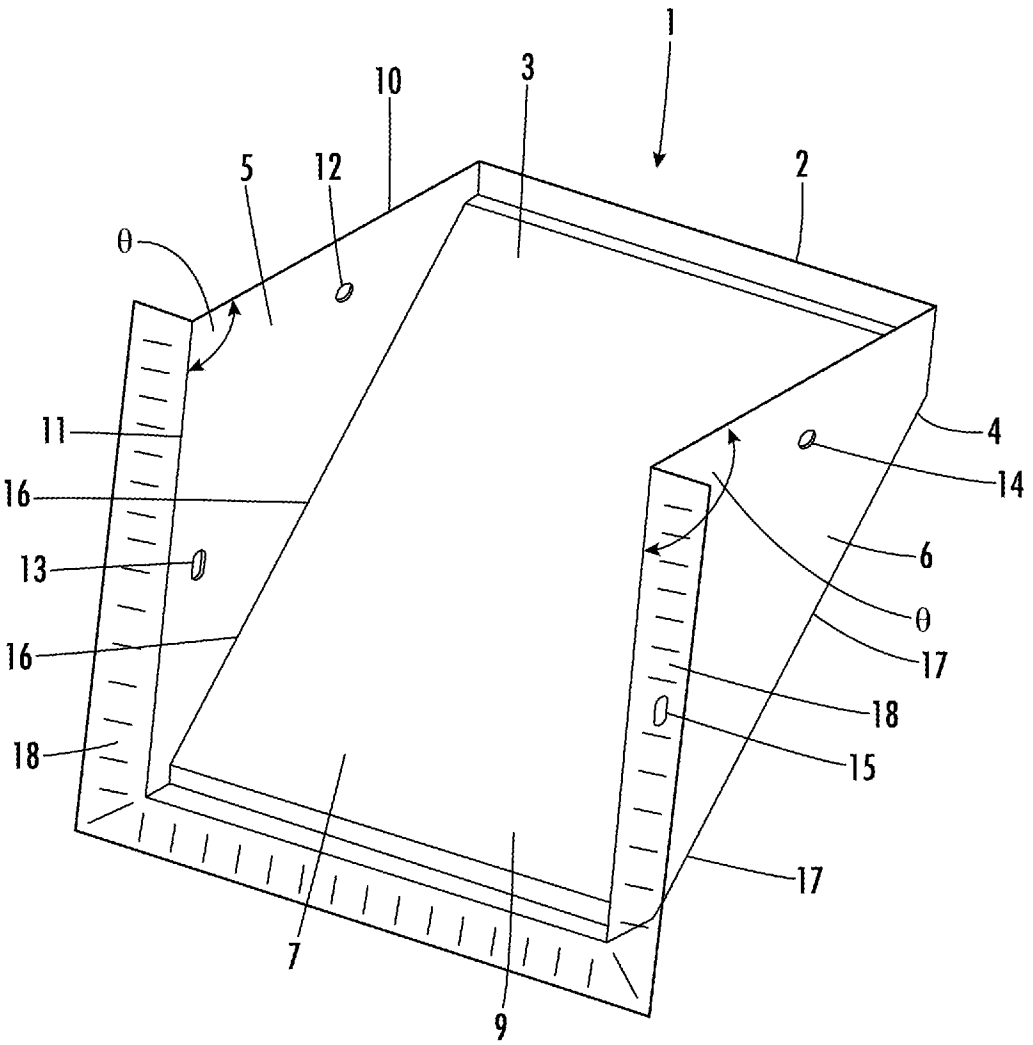
FIG. 4 is an embodiment of the corbel cover with a flange extending from the perimeter, for attaching the cover to the mount plate component of the corbel.

In addition to the tabs for attaching cover 1 to ledge 24, other embodiments of the invention may incorporate a different arrangement and/or type of receivers. By way of example, the sides of ledge 24, including base 24 and/or back plate 27 may be drilled and tapped to accept one or more threaded fasteners. Additionally, second section 11 of perimeter 9 of shell 2 may be provided with an outwardly projecting flange 18, as shown in FIG. 4. The flange may be secured with fasteners to receivers created in mount plate 20, such as by drilling and tapping the mount plate. Or the flange may be attached to mount plate 20 by welding or suitable adhesive compound. An advantage of the embodiment of the cover shown in FIG. 4 is that it may be attached to the base of the ledge and either (i) the back plate of the ledge (if one is employed in the corbel), or (ii) the mount plate.

FIG. 2 shows an example of fasteners that may be used in conjunction with the tabs extending from ledge 24. Fasteners 34-37 each have a threaded section for engaging tabs 30-33, respectively, and a head abutting exterior 4 of shell 2. There is no particular limitation on the type of fastener that may employed. In addition to threaded screws and bolts, the fastener may be a pulling rivet. Alternatively, the shell may be attached to the corbel by welding or use of a fire-resistant adhesive, such as a thermosetting adhesive, for example, an epoxy adhesive. An advantage of employing a threaded fastener, however, is that the cover may be removed from the corbel for periodic inspection.

FIG. 3 shows the corbel system when it is assembled. Beam 26 rests on base 25 of ledge 24. Cover 1 is installed with first section 10 of perimeter 9 adjacent the upper side of base 25 and second section 11 of perimeter 9 adjacent back plate 27. The interior of side 5 is in contact with one side of ledge 24, and the interior of side 6 is in contact with the opposite side of ledge 24, thereby minimizing the exposure of corbel 1 to heated gases, in case of a fire. Space 38 is created between gusset 29 of ledge 24 and interior 3 of shell 2, which allows room for a fire-resistant coating to be applied to the interior 3 of shell 2, and even enough room for an intumescent coating to expand.

The cover of the present invention has been tested and found to meet or exceed a 3-hour fire rating, according to ASTM-E119, when the shell is made of stainless steel.

The fire rating of the corbel system may be enhanced by providing a solid insulating material in space 38, that is, between an underside of base 25 and the face of mount plate 20. Useful insulating materials are solid at ambient temperature (25° C.) and may have a thermal conductivity of 0.075 W/m·° K or less, in particular, 0.05 W/m·° K or less, and a density of 50 lbs./ft$^3$ or less, in particular, 10 lbs./ft$^3$ or less.

There are, of course, many alternative embodiments and modifications of the invention, which are intended to be included in the following claims.

What is claimed is:

1. A fire-resistant corbel system for use with a precast concrete structure, the fire-resistant corbel system comprising:

(a) a corbel having (i) a mount plate with a plurality of slots extending through the mount plate, wherein the mount plate is embedded in the precast concrete structure with a face of the mount plate exposed, (ii) a ledge, having projections engaged in the slots of the mount plate, the ledge further having a horizontal base perpendicular to the mount plate, and the base having an underside, a first side and a second side, the ledge further comprising a first receiver tab and a second receiver tab, the first and second receiver tabs disposed at opposite sides of the ledge;

(b) a cover having (i) a metallic shell with an interior, an exterior, a first side, a second side opposite the first side, and a bottom extending from the first side to the second side, (ii) an opening defined by a perimeter, the perimeter has a first section lying in a first plane and a second section lying a second plane, whereby the first plane and the second plane are aligned at an angle of approximately 90°, and (c) wherein the cover encloses the underside of the base of the ledge and the face of the mount plate, wherein the cover is attached to the corbel with the first section of the perimeter aligned coplanar to the base of the ledge and the second section of the perimeter aligned coplanar with the mount plate, and wherein the cover defines holes that align with the first and second receiver tabs to receive fasteners configured to secure the cover to the corbel.

2. The corbel system of claim 1, wherein (i) the first side and the second side of the shell are parallel to each other, and (ii) the first side of the shell is attached to the first side of the horizontal base and the second side of the shell is attached to the second side of the horizontal base.

3. The corbel system of claim 2, wherein the first side of the shell is in the shape of a triangle having a first right angle positioned on the perimeter at an intersection of the first plane and the second plane, and wherein the second side of the shell is in the shape of a triangle having a second right angle positioned on the perimeter at an intersection of the first plane and the second plane, and wherein the first side of the shell is characterized by a hypotenuse opposite the first right angle, wherein the second side of the shell is characterized by a hypotenuse opposite the second right angle, and wherein the bottom of the shell extends from the hypotenuse of the first side to the hypotenuse of the second side.

4. The corbel system of claim 1, wherein the metallic shell has a thickness of 0.1 inches or less.

5. The corbel system of claim 4, wherein the shell is provided with a fire-resistant coating selected from the group consisting of intumescent, sprayed fiber and cementitious coatings.

6. The corbel system of claim 5, wherein the corbel system has a 3-hour fire rating, according to ASTM-E119 at a loading of 27,000 lbs.

7. The corbel system of claim 1, further comprising a space between the base of the ledge, the face of the mount plate, and the shell, and wherein the space contains a solid insulating material having a thermal conductivity of 0.075 W/m·° K or less.

8. The corbel system of claim 7, wherein the corbel system has a 3-hour fire rating, according to ASTM-E119 at a maximum loading of 27,000 lbs.

9. The corbel system of claim 1, wherein the plurality of slots in the mount plate are keyhole slots, and wherein the ledge is provided with (i) a back plate extending downward from the base at an angle of approximately 90°, the back plate having a plurality of studs extending from a rear the back plate and engaging the keyhole slots in the mount plate, and the back plate has a face, opposite the rear, a first side and a second side opposite the first side; and (ii) a gusset extending from the underside of the base to the face of the back plate.

10. The corbel system of claim 9, wherein the first receiver tab is configured to receive a first fastener, and the second receiver tab is configured to receive a second fastener, and the cover is attached to the corbel by (i) the first fastener extending through a first hole in the first side of the shell and engaging the first receiver tab, and (ii) the second fastener extending through a second hole in the second side of the shell and engaging the second receiver tab.

11. The corbel system of claim 10, wherein the first fastener has a head on the exterior side of the shell and a threaded shaft on the interior side of the shell engaging the first receiver tab, and wherein the second fastener has a head on the exterior side of the shell and a threaded shaft on the interior side of the shell engaging the second receiver tab.

12. The corbel system of claim 10, wherein the first side of the back plate of the ledge is provided with a third receiver for a third fastener, and the second side of the back plate of the ledge is provided with a fourth receiver for a fourth fastener, and the cover is attached to the corbel by (i) a third fastener extending through a third hole in the first side of the shell and engaging the third receiver, and (ii) a fourth fastener extending through a fourth hole in the second side of the shell and engaging the fourth receiver.

13. The corbel system of 12, wherein the third fastener has a head on the exterior side of the shell and a threaded shaft on the interior side of the shell engaging the third receiver, and wherein the fourth fastener has a head on the exterior side of the shell and a threaded shaft on the interior side of the shell engaging the fourth receiver.

14. The corbel system of claim 12, wherein the third receiver and fourth receiver are each a tab extending from the ledge, and the first receiver tab and third receiver are aligned coplanar with the first side of the shell, and the second receiver tab and fourth receiver are aligned coplanar with the second side of the shell.

15. The corbel system of claim 1, wherein the first section of the perimeter of the cover is attached to the horizontal base and the second section of the perimeter of the cover is attached to the mount plate.

16. The corbel system of claim 15, wherein the second section of the perimeter is provided with an outwardly extending flange, and a plurality of fasteners extend through the flange and engage the mount plate.

17. The corbel system of claim 1, wherein the cover further comprises an outwardly projecting flange.

18. The corbel system of claim 17, wherein the outwardly projecting flange is configured to receive one or more fasteners to couple the cover to the precast concrete structure.

19. The corbel system of claim 1, wherein the first receiver tab and the second receiver tab are oriented parallel with one another.

* * * * *